United States Patent [19]

Rosenberg

[11] Patent Number: 4,570,857

[45] Date of Patent: Feb. 18, 1986

[54] FLOW REGULATOR AND SPRAY NOZZLE INCLUDING SAME

[76] Inventor: Peretz Rosenberg, POB 3120, Ntehanya, 42 130, Moshav Beit Shearim, Israel

[21] Appl. No.: 524,609

[22] Filed: Aug. 19, 1983

[30] Foreign Application Priority Data

Aug. 23, 1982 [IL] Israel ..... 66608

[51] Int. Cl.[4] ..... B05B 1/26; B05B 1/30

[52] U.S. Cl. ..... 239/382; 137/504; 138/46; 239/499; 239/570

[58] Field of Search ..... 138/45, 46; 137/504, 137/517; 239/382, 452, 453, 454, 499, 570, 571, DIG. 16

[56] References Cited

U.S. PATENT DOCUMENTS

| | | | |
|---|---|---|---|
| 2,584,418 | 2/1952 | Branson | 137/504 |
| 3,091,398 | 5/1963 | Hruby, Jr. | 239/DIG. 16 X |
| 3,254,667 | 6/1966 | McGuire et al. | 137/504 |
| 3,339,580 | 9/1967 | Cutler et al. | 137/504 |
| 3,948,285 | 4/1976 | Flynn | 239/570 X |
| 4,356,974 | 11/1982 | Rosenberg et al. | 239/499 X |

FOREIGN PATENT DOCUMENTS

| | | | |
|---|---|---|---|
| 771027 | 3/1957 | United Kingdom | 137/504 |

*Primary Examiner*—Andres Kashnikow

*Attorney, Agent, or Firm*—Benjamin J. Barish

[57] ABSTRACT

A flow regulator comprises a sleeve fixed within a body member and formed with an opening serving as a metering passageway, a second sleeve displaceable with respect to the fixed sleeve so as to vary the effective size of the metering passageway, a spring biasing the displaceable sleeve in the direction to enlarge the met metering passageway, and a flow sensor element carried by the displaceable sleeve and impinged by the flowing fluid so as to displace the second sleeve in the direction of restricting the metering passageway. Also described is a spray nozzle including the above flow regulator, and a deflector floatingly mounted so as to be impinged by the jet issuing from the spray nozzle.

5 Claims, 2 Drawing Figures

FLOW REGULATOR AND SPRAY NOZZLE INCLUDING SAME

BACKGROUND OF THE INVENTION

The present invention relates to a flow regulator for regulating the flow of a fluid, particularly a liquid such as water. The invention also relates to a spray nozzle incorporating the flow regulator to regulate the flow of the fluid to the spray nozzle.

Flow regulators are commonly used to regulate the flow of a fluid to a utilization device, for example, to regulate the flow of water to a fluid distributing device such as a water sprinkler or a spray nozzle. Many different designs are known and in use, but as a rule, when the known devices are added to a water distribution device, such as a water sprinkler or a spray nozzle, they substantially increase the manufacturing cost for the overall device.

An object of the present invention is to provide a spray nozzle of very simple and inexpensive construction and incorporating a flow regulator to regulate the fluid flow to the nozzle.

SUMMARY OF THE INVENTION

According to the present invention, there is provided a spray nozzle including a flow regulator. The flow regulator comprises a body member having a fluid inlet at one end and a fluid outlet at the opposite end, a fixed sleeve fixed within the body member and formed with an opening serving as a metering passageway for the flow of fluid therethrough, a displacable sleeve coaxial with and displacable with respect to the fixed sleeve so as to vary the effective size of the metering passageway and thereby to vary the rate of flow of fluid therethrough, biasing means for biasing the displacable sleeve in the direction to enlarge the metering passageway, and a flow sensor element carried by the displacable sleeve and impinged by the fluid flowing through the body member so as to displace the displacable sleeve in the direction of restricting the metering passageway. The nozzle is secured to the outlet end of the body member downstream of the metering passageway and is formed with an outlet orifice through which the fluid issues in the form of a jet. A deflector is floatingly mounted with respect to the nozzle so as to be impinged by the jet issuing therefrom and to be moved in a lateral direction with respect to its orifice. The spray nozzle further includes limiting means limiting the floating movement of the deflector with respect to the nozzle orifice.

In a prefered embodiment of the invention described below, the flow sensor element is in the form of an annular flange at the end of the displaceable sleeve adjacent to the inlet end of said body member. In addition, in this described embodiment, the limiting means comprises a stem passing through an apertured wall at the upstream end of the fixed sleeve; one end of the stem carrying the deflector, and the opposite end of the stem, upstream of the apertured wall, carrying an annular plug which substantially closes the apertured wall of the fixed sleeve during the flow of fluid through the body member, and thereby directs the fluid flow to the annular flange sensor element.

The deflector, in the novel spray nozzle, may be of the type described in U.S. Pat. No. 3,958,760, namely formed with a recess centrally of the face thereof impinged by the jet. The deflector could also be in the form of a cup having a substantially thin side wall relative to the cup's diameter, as described, for example, in U.S. Pat. No. 4,356,974.

Spray nozzles constructed in accordance with the foregoing features provide a number of important advantages. Thus, the flow regulation is an added feature which does not substantially increase the overall cost of the spray nozzle, at least when compared to other forms of spray nozzles including flow regulation units added to them. In addition, with the foregoing arrangement wherein the floating deflector is carried by a stem whose upstream end is formed with an annular plug which substantially closes the apertured upstream end wall of the fixed sleeve, it has been found that there is a more equal distribution of the vibration of the stem and deflector in all the directions. This has been found not only to provide a more equal distribution of the fluid spray, but also to produce less abrasion of the nozzle during use, thereby substantially contributing to its overall life. Further, in the described arrangement, the water output rate of the spray nozzle is determined by the flow regulator, so that the spray nozzle can be formed with openings having relatively large diameters and therefore less sensitive to clogging than the previous spray nozzles.

A further advantage in the described flow regulator having the foregoing features is that it is substantially insensitive to line pressure variations. Thus, most of the previously known flow regulators are sensitive to line pressure such that the flow at the downstream, lower-pressure end of a line is substantially less than the flow at the upstream, higher-pressure end of the line. In the flow regulator of the present invention, the flow sensor element is similar to that used in a target-type flowmeter, which element is sensitive to the rate of flow rather than to the line pressure, so that the flow regulation is relatively unaffected by the line pressure.

Further features and advantages of the invention will be apparent from the description below.

BRIEF DESCRIPTION OF THE DRAWINGS

The invention as herein described, by way of example only, with reference to the accompanying drawings, wherein.

DESCRIPTION OF PREFERRED EMBODIMENTS

Figure 1:
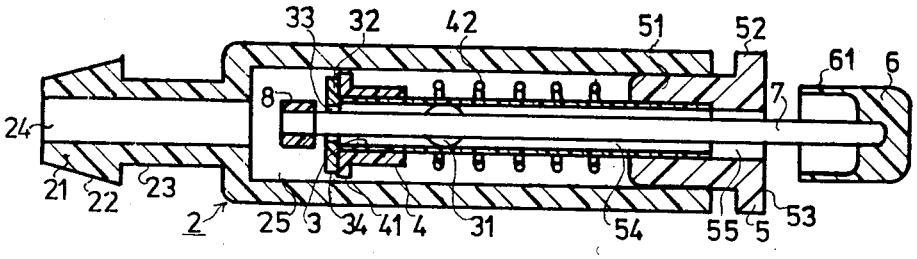
FIG. 1 is a longitudinal sectional view illustrating one form of spray nozzle incorporating a flow regulator constructed in accordance with the present invention.

The spray nozzle illustrated in FIG. 1 is of the type adapted to be connected to a pressurized water supply pipe (not shown) for distributing the water in the form of an annular spray around the nozzle. Briefly, the spray nozzle comprises a body member, generally designated 2, having one end adapted to be inserted into the water supply line (not shown); an inner sleeve 3 fixed within the body member; another sleeve 4 coaxial with sleeve 3 and displaceable with respect thereto; a nozzle head 5 applied to the outlet end of the body member 2; a deflector; and a floating mounting including a stem 7 and an annular plug 8 for the deflector 6.

More particularly, the body member 2 is formed with a connector 21 at one end, for connecting to the water supply line (not shown). The connector portion 21 of the body member is formed with a conical surface 22 to facilitate its insertion through the apertured wall of a water supply pipe, and is further formed with an annular recess 23 for receiving the apertured wall and for securely supporting the body member thereto. The body member 2 includes a first bore 24 leading through the connector portion 21 to a second enlarged bore 25 in which are disposed the fixed sleeve 3 and the displaceable sleeve 4.

Fixed sleeve 3 is supported by the nozzle head 5 which head is carried by the downstream end of the body member 2. In the arrangement illustrated in FIG. 1 sleeve 3 is press-fitted into the nozzle 5, and the latter is press-fitted into the open end of the body member 2.

Fixed sleeve 3 is formed with an aperture 31 at a midportion of the sleeve. This aperture serves as a metering passageway for metering the flow of the water passing through body member to the nozzle head 5. At the upstream side of the metering passageway 31, sleeve 3 is provided with an end wall 32 formed with a central aperture 33 for receiving the stem 7 of the spray nozzle. The outer diameter of end wall 32 is larger than the outer diameter of sleeve 3 itself, so that the end wall also defines an annular flange 34 projecting radially outwardly of the sleeves. The outer diameter of the end wall 32, however, is less than the inner diameter of bore 25 of the body member 2 to provide an annular space for the flow of the water between the outer face of the end wall and the inner face of the body member.

Displaceable sleeve 4 in slidably received over sleeve 3 so as to be coaxial with that sleeve and is of substantially shorter length than sleeve 3. Thus, sleeve 4, in its normal position as illustrated in FIG. 1, does not cover any part of, or perhaps only a small part of, the metering passageway 31 through sleeve 3. Displaceable sleeve 4 further includes an annular flange 41 at its upstream end engageable with annular flange 34 of sleeve 3, and is biassed in this position by means of a coiled spring 42 interposed between the opposite end of sleeve 4 and the inner face of the nozzle head 5.

Annular flange 41 at the upstream end of the displaceable sleeve 4 has an outer diameter which is larger than that of annular flange 34 of the fixed sleeve 3, but smaller than the inner diameter of bore 25 in the body member 2. Thus, an annular clearance or passageway is provided for the passage of the fluid between the outer face of flange 41 and the inner face of the body member.

Nozzle head 5 is formed with an annular connector section 51 press-fitted into the end of the body member 2, and with an enlarged head section 52 having a flat outer face 53. Bore 54 through connector section 51 of the nozzle member 5 is of slightly larger diameter than bore 55 through the head section 52 of the nozzle member in order to accommodate the fixed sleeve 3 press-fitted into bore 54 and to form a substantially flush surface between the inner face of sleeve 3 and the inner face of bore 55. Bores 54 and 55 are of such diameter that the water flowing through these bores around stem 7 issues as a jet from the flat face 53 of the nozzle member 5.

The jet issuing form nozzle member 5 impinges deflector 6, which deflector is effective to deflect the jet and to produce an annular spray around the nozzle. Deflector 6 is illustrated in FIG. 1 as of the cup type described in U.S. Pat. No. 4,356,974, wherein its sidewall 61 is of substantially smaller thickness than the diameter of the cup itself. As described in that Patent, an air cushion is produced within the cup, which air cushion is effective to deflect the water and to produce the annular spray around the nozzle.

Deflector cup 6 is floatingly mounted by means of the stem 7. That is to say, the stem permits the cup to move in a lateral direction with respect to the nozzle orifice 55, and also in the direction inwardly and outwardly towards and away from the nozzle orifice 55. This floating movement of the deflector cups 6 is limited by plug 8 carried at the opposite end of stem 7, i.e., downstream of the apertured end wall 32 of the fixed sleeve 3.

Plug 8 is of annular shape and is of a larger diameter than the aperture 33 formed in end wall 32. Thus, when there is water flow through the body member 2, the water applies a force against plug 8 causing it to close the aperture 33 through the end wall 32 of the fixed sleeve 3, thereby forcing the water to flow through the annular space around flange 34 of the fixed sleeve 3, and around flange 41 of the displaceable sleeve 4.

Since flange 41 is of larger diameter than flange 34, this flow of water will apply a force to flange 41, and thereby to the displaceable sleeve 4, tending to move the latter sleeve rightwardly in FIG. 1 against the bias of spring 42, to close the metering passageway 31 through the fixed sleeve 3.

The spray nozzle illustrated in FIG. 1 operates as follows: First, the spray nozzle is attached to the water supply pipe by inserting the connective portion 21 of body member 2 through an opening in the water supply pipe wall, whereupon communication is established between the interior of the water supply pipe and bores 24 and 25 of the body member 2.

If there is no water flow, or if the water flow rate is very small, spring 42 will urge the displaceable sleeve 4 to its leftmost position, as illustrated in FIG. 1, whereupon it will substantially unblock the metering passageway 31 through the fixed sleeve 3. As soon as there is a significant flow of water, plug 8 is moved against aperture 33 through the end wall 32 of the fixed sleeve 3, blocking that aperture and thereby directing the water to flow through the annular space around flanges 34 and 41 of the fixed sleeve 3 and displaceable sleeve 4, respectively. From there, the water flows through the metering passageway 31 to the interior of the fixed sleeve 3 and out through the nozzle orifice 51 in the form of a jet, whereupon it impinges the cup deflector 6 and is deflected, by the air cushion within the cup, to produce the annular spray around the nozzle member 5.

So long as the rate of flow of the water is relatively low, spring 42 will urge the displaceable sleeve 3 to its leftmost position, illustrated in FIG. 1, substantially unblocking the metering passageway 31 through the fixed sleeve 3. However, as the rate of flow increases, the force applied by the flowing water to the annular flange 41 of the displaceable sleeve 4 increases, thereby causing the sleeve to move rightwardly against spring 42 to partially block the metering passageway 31, thereby restricting the flow through the metering passageway.

It will thus be seen that sleeve 4 will be displaced in response to the rate of flow in order to increase or decrease the size of the metering passageway 31. In this manner, sleeve 4 regulates the rate of flow through the nozzle member 5 to the deflector 6.

It will also be seen that the portion of the annular flange 41 on the displaceable sleeve 4 which projects past the annular flange 34 on the fixed sleeve 3 serves as the flow sensor element. It will also be seen that this element is subjected to a force produced by the flow of the fluid, and is not affected by the static pressure of the fluid supply line. Accordingly, the regulation resulting from the illustrated construction is substantially insensitive to the pressure of the water in the supply pipe, but rather is sensitive only to the rate of flow of the water through the regulator to the spray nozzle.

The illustrated construction provides a number of other important advantages particularly when embodied in the spray nozzle illustrated in FIG. 1. Thus, the use of the annular plug 8 at the end of stem 7 for limiting the floating movement of the deflector cup 6 produces a more equal distribution of the vibrations of the deflector cup in all the directions, when compared to the cross-bar limit commonly used in spray nozzles of this type. This more equal distribution of the vibration not only produces a more equal distribution of the water spray around the nozzle, but also results in less abrasion to the spray nozzle thereby substantially extending its useful life.

Further, by incorporating the flow regulator in the spray nozzle, the water output rate of the nozzle is determined by the regulator, so that the spray nozzle may be provided with relatively large bores which have less sensitivity to clogging by foreign particles in the water.

Figure 2:
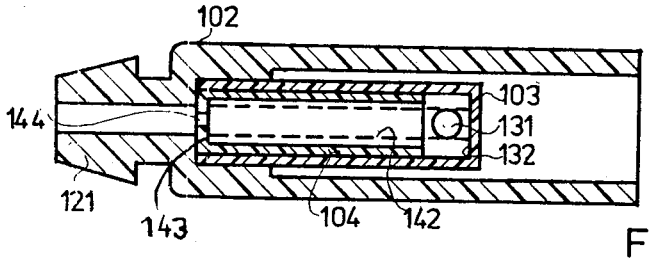
FIG. 2 is a longitudinal sectional view illustrating a variation in the construction of the flow regulator.

FIG. 2 illustrates another flow regulator constructed in accordance with the present invention, including a body member 102, a fixed sleeve 103, and a displaceable sleeve 104. As in the FIG. 1 embodiment, the fixed sleeve 103 is formed with a metering passageway 131; and the displaceable sleeve 104 is biassed by a coil spring 142 in the direction normally enlarging the metering passageway 131, but is displaced to restrict the passageway upon an increase in the flow.

In the regulator illustrated in FIG. 2, the fixed sleeve 103 is press-fitted at its open, upstream end within the body member 102, and is closed at its downstream end by an end wall 132. In addition, the displaceable sleeve 104 is disposed within the fixed sleeve 103 and is closed at its upstream end by a wall 143 formed with a central opening 144.

In use, the regulator illustrated in FIG. 2 is attached to a water supply pipe by passing its connector end 121 through the apertured wall of the pipe, in the same manner as described above with respect to FIG. 1. A spray nozzle, water sprinkler, or other water distribution device may be inserted into the opposite end of the body member 102. The water introduced through its inlet end impinges end wall 143 of the displaceable sleeve 104 and passes through central opening 144 into the interior of the sleeve, and then out through the metering passageway 131 formed in the fixed sleeve 103. Under low rates of flow, displaceable sleeve 104 will be urged by its spring 142 to enlarge metering passageway 131, as shown in FIG. 2; but as the flow rate increases, a force is applied to end wall 143 of the displaceable sleeve, tending to move the latter sleeve, against the bias of its spring 142, to restrict metering passageway 131, and thereby to decrease the rate of flow of the water through the device.

While the invention has been described with respect to two preferred embodiments, it will be appreciated that many other variations, modifications and applications of the invention may be made.

What is claimed is:

1. A spray nozzle comprising: a body member having a fluid inlet at one end and a fluid outlet at the opposite end; a fixed sleeve fixed within said body member and formed with an opening serving as a metering passageway for the flow of fluid therethrough; a displacable sleeve coaxial with and displacable with respect to said fixed sleeve so as to vary the effective size of said metering passageway, and thereby to vary the rate of flow of fluid therethrough; biassing means for biassing said displacable sleeve in the direction to enlarge said metering passageway; a flow sensor element carried by said displacable sleeve and impinged by the fluid flowing through said body member so as to displace said displacable sleeve in the direction of restricting said metering passageway; a nozzle secured to the outlet end of said body member downstream of said metering passageway and formed with an outlet orifice through which the fluid issues in the form of a jet; a stem passing through said fixed and displacable sleeve and movable independently of said sleeves in the axial and lateral directions with respect thereto; a deflector mounted on said stem so as to be impinged by the jet issuing from said orifice and movable with said stem axially and laterally with respect to said orifice; and limiting means limiting the movements of the stem and the deflector with respect to the nozzle orifice.

2. The spray nozzle according to claim 1, wherein said flow sensor element is in the form of an annular flange at the end of said displaceable sleeve adjacent to the inlet end of said body member.

3. The spray nozzle according to claim 1, wherein said stem passes through an apertured wall at the upstream end of said fixed sleeve; one end of said stem carrying said deflector, and the opposite end of said stem, upstream of said apertured wall, carrying an annular plug which substantially closes said apertured wall of the fixed sleeve during the flow of fluid through said body member, and thereby directs the fluid flow to said annular flange sensor element.

4. The spray nozzle according to claim 3, wherein said deflector is formed with a recess centrally of the face thereof impinged by the jet.

5. The spray nozzle according to claim 3, wherein said deflector is in the form of a cup having a relatively thin side wall in relation to the cup diameter.

* * * * *